US007042806B2

(12) United States Patent
Fox et al.

(10) Patent No.: US 7,042,806 B2
(45) Date of Patent: May 9, 2006

(54) MAT FOR TIMING COMPETITIONS

(75) Inventors: Robert W. Fox, Highlands Ranch, CO (US); John L. Goers, Castle Rock, CO (US)

(73) Assignee: Speedstacks, Inc., Englewood, CO (US)

( * ) Notice: Subject to any disclaimer, the term of this patent is extended or adjusted under 35 U.S.C. 154(b) by 0 days.

(21) Appl. No.: 11/026,626

(22) Filed: Dec. 30, 2004

(65) Prior Publication Data

US 2005/0117456 A1 Jun. 2, 2005

Related U.S. Application Data

(63) Continuation-in-part of application No. 10/172,652, filed on Jun. 14, 2002, now Pat. No. 6,940,783.

(51) Int. Cl.

| | |
|---|---|
| ***G04B 47/00*** | (2006.01) |
| ***G04F 8/00*** | (2006.01) |
| ***A63B 67/00*** | (2006.01) |
| ***A63B 71/00*** | (2006.01) |

(52) U.S. Cl. ..... 368/10; 368/110; 368/113; 273/441; 273/445

(58) Field of Classification Search ..... 368/1–10, 368/107–113; 273/441, 445

See application file for complete search history.

(56) References Cited

U.S. PATENT DOCUMENTS

| | | | |
|---|---|---|---|
| 3,649,010 | A | 3/1972 | Jeffery et al. |
| 3,878,675 | A | 4/1975 | Prociuk |
| 4,220,330 | A | 9/1980 | Montgommery |
| 4,392,176 | A | 7/1983 | Kneip et al. |
| 4,518,266 | A | 5/1985 | Dawley |
| 4,586,709 | A | 5/1986 | Godinet |
| 4,700,369 | A | 10/1987 | Siegal et al. |
| 4,703,930 | A | 11/1987 | Gilbert |
| 4,818,234 | A | 4/1989 | Redington et al. |
| 5,019,950 | A | 5/1991 | Johnson |
| 5,057,965 | A | 10/1991 | Wilson |
| 5,652,975 | A | 8/1997 | Hoskin |
| 5,838,638 | A | 11/1998 | Tipton et al. |
| 5,844,861 | A | 12/1998 | Maurer |
| 5,933,102 | A | 8/1999 | Miller et al. |
| 6,181,647 | B1 | 1/2001 | Tipton et al. |
| 6,229,764 | B1 | 5/2001 | Tongue |

*Primary Examiner*—Vit W. Miska
(74) *Attorney, Agent, or Firm*—Sheridan Ross P.C.

(57) ABSTRACT

The present invention describes an apparatus and method for timing manual dexterity and hand-eye coordination competitions. Specifically, the present invention relates to an apparatus and method for timing cup stacking competitions. The apparatus of the present invention includes a mat which may incorporate a timer and the cups which are to be stacked on the mat. One embodiment of the present invention includes a multi-pieced timing mechanism which may be selectively interconnected to a mat. Further, a plurality of these timing mechanisms may be used remotely from the mat or with the mat such that a plurality of players may be used in individual mats.

39 Claims, 9 Drawing Sheets

MAT FOR TIMING COMPETITIONS

This application is a Continuation-In-Part of U.S. patent application Ser. No. 10/172,652, filed Jun. 14, 2002, now U.S. Pat. No. 6,940,783, which is incorporated by reference in its entirety herein.

FIELD OF THE INVENTION

This application relates generally to an apparatus and method for use in timing competitive play and more specifically to an apparatus for use in the timing of cup stacking competitions.

BACKGROUND OF THE INVENTION

Cup stacking first became popular in the mid 90s as a method of teaching physical coordination, including hand-to-eye coordination, to youngsters. Cup stacking helps students use both sides of their bodies and brains, develop ambidexterity, develop quickness, and improve concentration. Cup stacking also helps teach sequencing and patterning, which can help in developing math and reading skills. The sport has grown in popularity throughout the country, primarily in elementary schools, where it has become a part of many physical education programs. Generally, the sport involves stacking and unstacking a set of specially designed cups in pre-arranged sequences while being timed. The object of the competitions is to complete the sequence or sequences in as short a time as possible. There are several standard sequences and the competitions can be performed by an individual or by a team in a relay fashion.

Timing of the competition is usually performed by a judge with a stopwatch. The competitor begins with both hands face down on the table where the cups are to be stacked. The judge gives a verbal cue, usually "Ready, Get Set, Go", starting the stopwatch on the word GO. Time is stopped when the last cup is down stacked in the particular sequence.

One of the major drawbacks to the sport has been the inaccuracy associated with having different individuals time the competitors using stopwatches. Errors in timing due to variations in human reaction time often exceed several tenths of a second and are significant (as much as 10% off) when measuring competitive times. Competitive times in this sport range from 2 to 15 seconds with winners of the competition usually determined by hundredths of seconds. To mitigate against the human reaction time, in final competitions, three judges are used and the high and low times are not counted against the competitor. This measure, however, is inefficient and does not cure the inaccuracies inherent with using human judges since the measured time to complete the sequence is still subjective.

Another drawback to the sport is the surface on which the cups are stacked. At present, there are no surfaces which are the same for competitions. Some tournaments use tables covered with short nap carpeting while others use a standard Formica® table top. In addition, the competitors do not always have access to the competition surface in order to practice their sport in a competitive environment. This lack of consistency among the surfaces upon which the cups are stacked is a further problem for competitive cup stackers.

SUMMARY OF THE INVENTION

Each of the embodiments of the present invention described herein solves both the timing problem and the surface problem described above. Each of the embodiments includes a mat. The mat of the present invention may provide a consistent surface upon which cups are to be stacked. The present invention includes an embodiment where the mat is used as a surface upon which cups are stacked in a cup stacking competition or in practice for a cup stacking competition.

Most of the embodiments of the present invention also include a timing mechanism. The timing mechanism may be incorporated into the mat or otherwise be associated with the mat. In either case, the timing mechanism solves the inaccuracies associated with utilizing human judges.

One embodiment of the present invention describes an apparatus comprising support means, trigger means connected to the support means, and timing means operatively connected to the trigger means. Another embodiment of the present invention describes an apparatus comprising a mat, a pressure sensitive trigger connected to the mat, and a timer operatively connected to the trigger so that the timer begins to accrue time with a first activation of the trigger and stops with a second activation of the trigger.

Yet another embodiment of the present invention describes a system that has an apparatus and a plurality of cups. The apparatus of this embodiment comprises a mat, a trigger connected to the mat, and a timer operatively connected to the trigger so the timer begins to accrue time with a first activation of the trigger and stops with a second activation of the trigger.

Another embodiment of the present invention includes a two-piece timing system that selectively interconnects to the mat. Preferably, one embodiment of the present invention includes an upper timing portion and a lower timing portion that sandwiches the mat therebetween. This embodiment of the present invention allows the mat to be altered or replaced pursuant to the desires of the players such that any size or shape of mat may be used. Alternatively, many timers may be used in conjunction with a single mat such that a plurality of players may be able to use the same mat at the same time. In an alternate use, the timer may be used remotely from the mat, which will be understood further after review of the drawings included herewith.

The present invention also includes a method of timing a competition that comprises arming a trigger connected to the mat and operatively connected to the timer, starting the timer, completing the tasks on the mat, and stopping the timer. The present invention further includes a method of cup stacking utilizing a plurality of cups comprising placing the mat on a table or desk, stacking the plurality of cups on the mat, and unstacking the plurality of cups on the mat.

These and other objects, features, and advantages of the invention will become apparent from the following best mode description, the drawings and the claims. The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
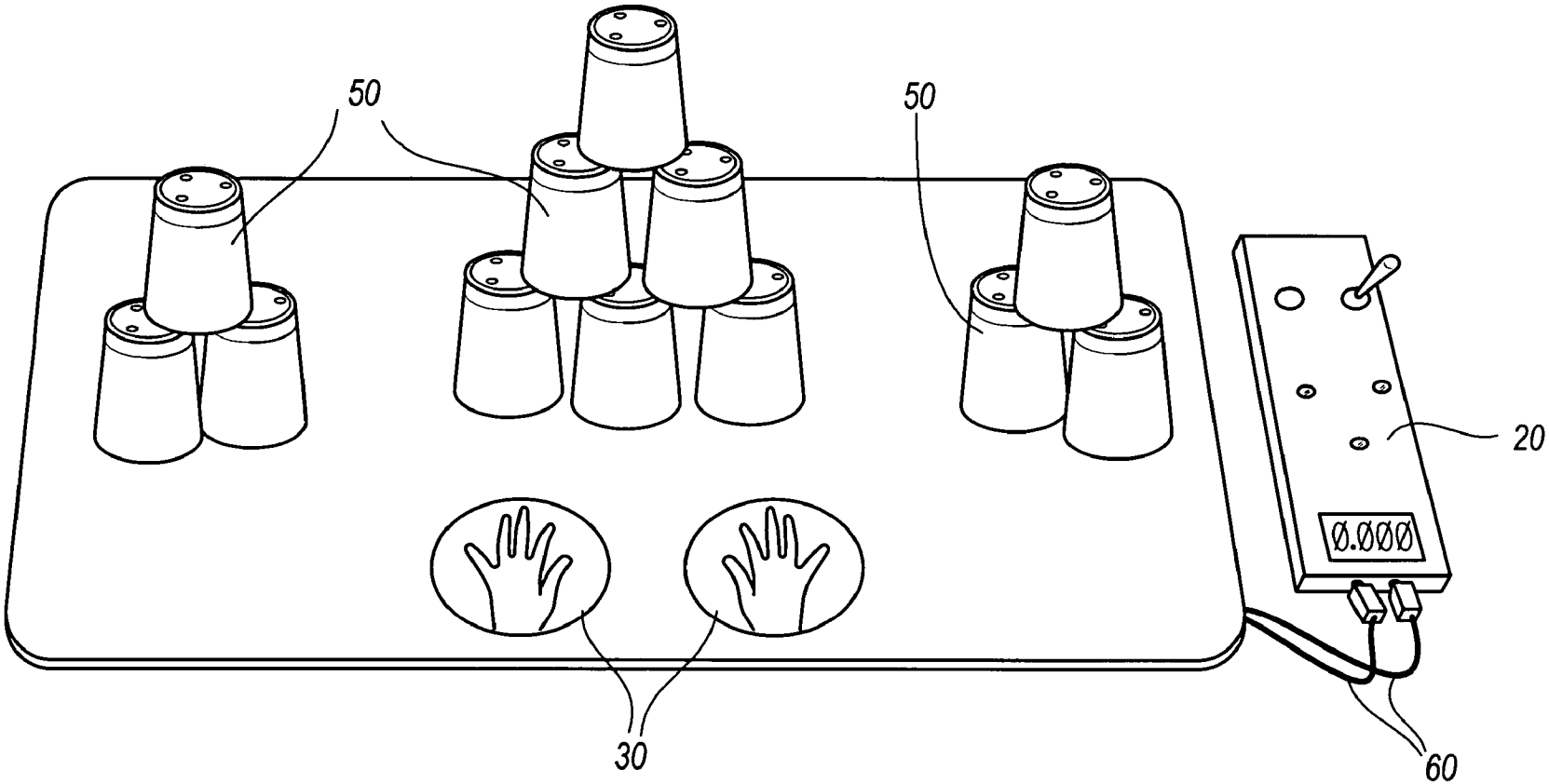
FIG. 1 depicts a top perspective view of the components of one embodiment of the invention.

To assist in the understanding of the present invention the following list of components and associated numbering found in the drawings is provided herein:

| Component | # |
|---|---|
| Mat | 10 |
| Foam backing | 11 |
| Fabric Surface | 12 |
| Timer | 20 |
| Upper Timer Portion | 20A |
| Lower Timer Portion | 20B |
| Readout Display | 21 |
| Wire/Trace Connectors | 22 |
| Power Switch | 24 |
| Reset Button | 23 |
| Indicator Lights | 25 and 27 |
| "ARM" Light | 26 |
| Trigger | 30 |
| Film Covering | 33 |
| Traces | 34 |
| Cups | 50 |
| Wires | 60 |
| Console | 62 |
| Magnet | 64 |
| Aligner tab | 66 |
| Boss | 68 |
| Boss cavity | 70 |
| Alignment tab cavity | 72 |
| Power supply | 74 |
| Boss aperture | 76 |
| Wall | 78 |
| Console | 80 |
| Boss cavity | 82 |
| Alignment tab cavity | 84 |
| Magnet | 86 |
| Alignment boss | 88 |
| Alignment tab | 90 |
| Wall | 92 |
| Aperture | 94 |

It should be understood that the drawings are not necessarily to scale. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION OF THE DRAWINGS

Initially, it should be understood that this invention comprises a method and an apparatus for timing competitions, particularly, competitions focusing on hand eye coordination and manual dexterity and, more particularly, cup stacking competitions. The description that follows describes various embodiments of the invention. It should be readily apparent to those skilled in the art, however, that various other alternative embodiments may be realized without departing from the spirit or scope of the invention.

The mat of one embodiment of the present invention is made from any material that provides a non-slip surface on one side of the mat and a smooth, even surface on the reverse side. One should note that the smooth side of the mat should be such that the cups do not slip when placed on the mat. The mat may be made from various types of fabric (alone or in combination with a backing), various types of short nap carpeting, closed cell foam, vinyl covered surfaces, any combination of these, and the like.

It has been found that materials commonly used for computer mouse pads work well for the purposes of the present invention. These materials have a fabric surface bonded to a foam substrate or backing. The foam backing gives the mat integrity, while providing flexibility and a soft feel to the mat. The foam backing is also water resistant and provides a stable base throughout the life of the mat. The foam backing typically used in mouse pads is a closed cell foam, which also works with the present invention. As with mouse pads, the foam backing used in the present invention should have non-skid properties. These properties will allow the mat to be placed on a table or other surface and will prevent the mat from sliding while the cups are being stacked and unstacked.

A fabric provides a stacking surface that is smooth and even, yet does not allow the cups to stick or slide. The surface may be made of any fabric such as polyester. However, a flocked fabric surface is also suitable. In addition, the fabric surface may be imprinted or designed in various ways. Designs can include, but are not limited to, school colors, mascots, and the like.

The mat can easily be stored by simply rolling the material into a tube. In addition, a bag or enclosure for housing the mat while it is not in use may be provided. The bag can be designed to house only the mat or it can be designed to house additional items, such as the cups and a timer. The mat can have bands or ties which will help secure and keep the mat in a rolled position, similar to the way that such bands or ties are used on sleeping bags.

It should be noted that the invention contemplates using the mat alone, either while the competitor is learning how to stack, practicing stacking, or competing in a cup stacking competition. In most of the embodiments of the present invention, the mat is connected to at least one trigger mechanism, which is connected to a timer mechanism. The trigger mechanism starts and stops the timer. The mat can incorporate the trigger so that the mat and trigger form an integral unit or the trigger can be located apart from the mat. The trigger can be any type of trigger that will start and stop a timer, including but not limited to capacitive switches, inductive switches, photoelectric or photo optic sensors, dry contact switches or conductive contact points. The trigger should also meet the following criteria: 1) have an extremely low profile so that the trigger(s) does not interfere with cup stacking; 2) be tuned to filter out false signals, such as a cup being placed on the trigger; 3) be covered with a film or other covering to keep the trigger safe from environmental conditions; 4) allow small amounts of pressure to operate; and 5) be inexpensive. It has been found that a capacitive touch trigger or pressure sensitive trigger works well with the present invention. In addition, it has been found that, for the purposes of cup stacking competitions, two touch pad triggers work well. However, it should be noted that any number of touch pad triggers can be used with the present invention. For example, for use with a relay event in cup stacking, the mat can incorporate four or more touch pad triggers to allow each competitor in the relay team access to their own set of touch pad triggers. In addition, an array of sensors can also be created which allows the competitor to place two hands anywhere within a specified boundary to trigger the timer. This array can be constructed using any of the aforementioned types of sensors or any combination thereof.

Figure 4:
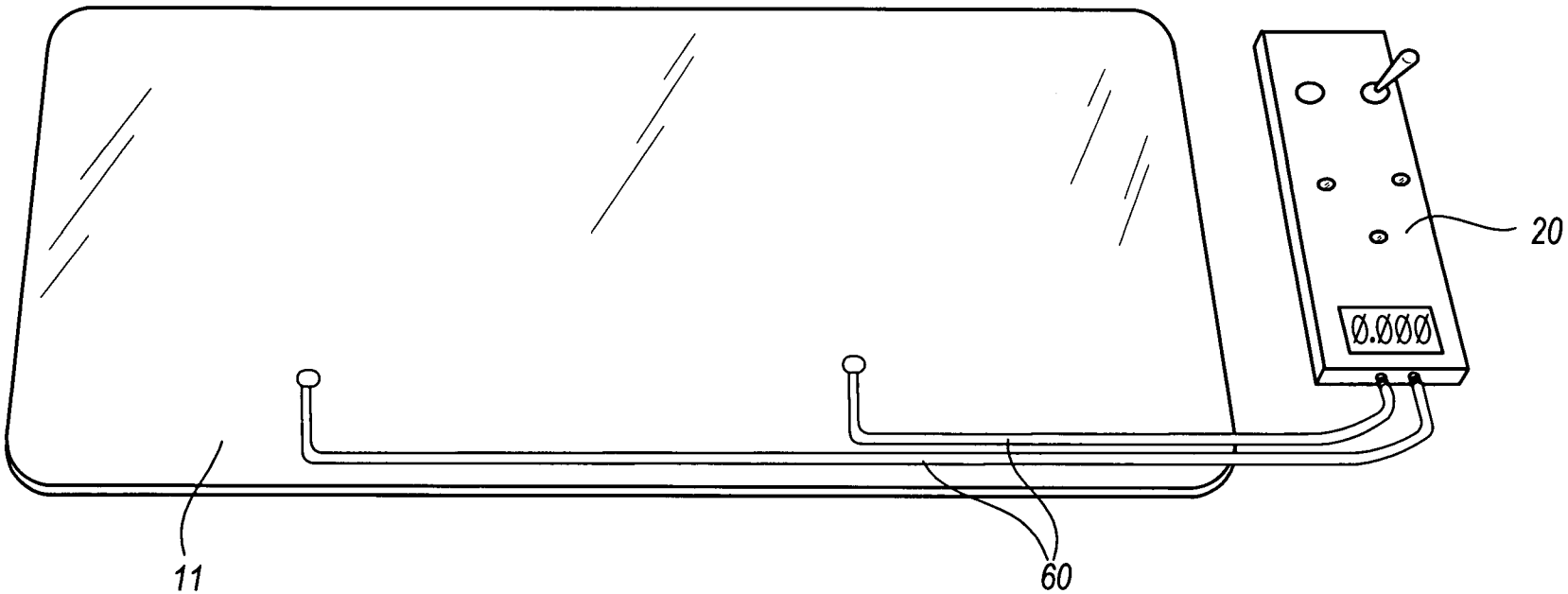
FIG. 4 depicts a bottom perspective view of the mat of one embodiment of the invention.

In one embodiment, the touch pad triggers are formed by printing conductive ink traces to the backside of a film covering. The traces conduct a signal generated from the touch pad triggers to the timer. The trigger area is formed by increasing the circular area of the trace. Thus, in this embodiment, the trigger is part of the trace. Wires are connected to the traces to conduct the signals generated to the timer. The film covering has an adhesive backing which adheres the film to the mat. The film covering can be made of any material, such as Mylar. In this embodiment, the traces are printed on the backside of the film covering and conduct signals from the trigger section to the timer mechanism. The wires can run along the bottom of the mat (the surface that will be laid on the table) as shown in FIG. 4, or may be integrated into the mat so that the wires are not visible from the back of the mat. Conductive traces can also be used instead of wires and can be built into the mat so that the traces are not visible from the back of the mat. The film covering can be adhered directly on top of the top surface of the mat. One of skill in the art will recognize other means of securing the touch pad triggers to the mat and it should be understood that all means of securing the touch pad triggers to the mat are specifically contemplated by the inventors for use with the present invention.

The timer mechanism can be any kind of timer that meets the following criteria: 1) is capable of timing to at least 0.01 seconds; 2) is able to be started and stopped by the competitor without reliance on any third party; 3) is predictable, repeatable, reusable, and reliable; 4) does not interfere with the stacking process; and 5) is able to be operated using a free standing power source, such as batteries, for long periods of time without resort to auxiliary power sources. A timer found suitable for use with the present invention includes a timer constructed from standard electronic components, including a microprocessor to accurately keep time, a LED display, discrete light emitting diodes, a reset switch, a power switch and a power source. The power switch is shown in the figures as a toggle switch; however, it should be noted that type of switch is appropriate for use in the present invention. It may be preferable to have the power switch and the reset switch be different types of switches so that competitors and judges do not become confused. The timer is, preferably, powered by batteries to allow for maximum portability of the mat and timer, however, the invention may incorporate a power coupling to allow the timer to be connected to an external power supply or other suitable power source.

As shown in FIG. 1, the cup stacking system is comprised of a mat 10, a timer 20, touch pad triggers 30, wires 60 connecting the timer 20 to the touch pad triggers 30, and a plurality of cups 50. FIG. 1 depicts a set of twelve cups arranged in a 3-6-3 position with the timer as a separate unit from the mat and triggers incorporated into the mat. It should also be noted that the triggers and the timer may be incorporated into the mat to form an integral unit.

Figure 2:
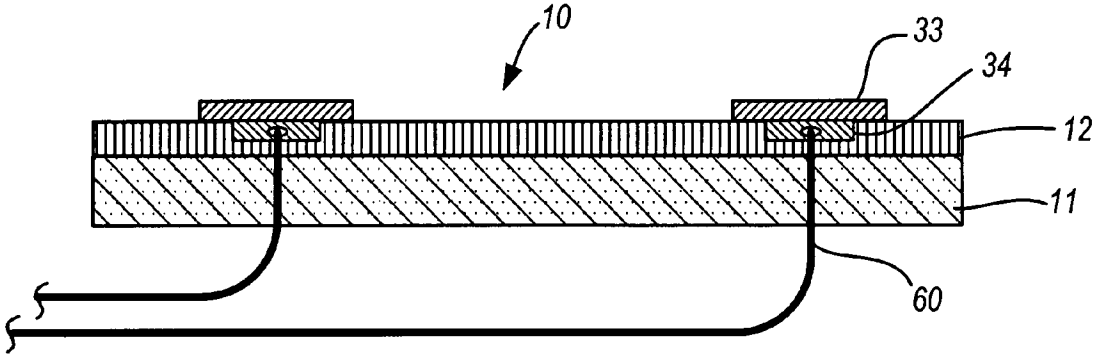
FIG. 2 depicts a front cross sectional view of the mat of one embodiment of the present invention.
Figure 3:
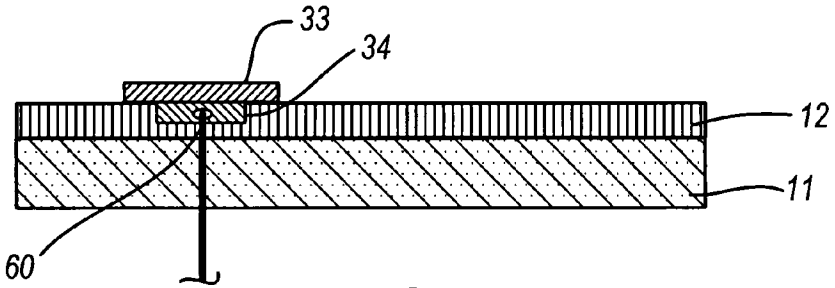
FIG. 3 depicts front cross sectional view of the mat of one embodiment of the present invention.

FIG. 2 is a mat made from material generally used in computer mouse pad construction showing both touch pad triggers 30. The foam backing 11 is bonded to the fabric surface 12 of the mat 10. The touch pad trigger, comprising the film covering 33 and the capacitive antenna 34, are placed on the fabric surface 12 of the mat 10. The trace or wire 60 is connected to the capacitive antenna 34 and is also connected to the timer through the wire connectors 22 (shown in FIG. 5). FIG. 3 depicts the same elements but from a side view where only one of touch pad triggers is shown.

Figure 5:
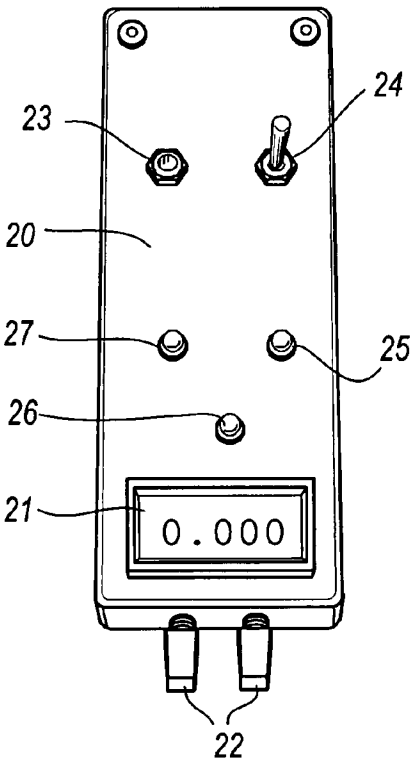
FIG. 5 depicts a top perspective view of the timer of one embodiment of the present invention.

FIG. 5 shows the timer 20 of one embodiment of the present invention. The timer is shown separated from the mat but may be alternatively attached to the mat. The timer has a power switch 23, which can be any kind of switch that will allow electricity to flow through the circuit board and the various elements of the timer. In addition, the timer 20 includes a readout display 21 where the time is shown. The timer 20 is connected to the touch pad triggers 30 through the wire connectors 22. This connection may be through wires or through conductive traces. The timer 20 has, in this embodiment, two indicator LEDs 25 and 27, each of which corresponds to one of the touch pad triggers, and will illuminate when pressure is sensed by a touch pad trigger. Alternately, a single LED may be used to indicate the presence of both hands. When pressure is applied to the touch pad triggers 30 for longer than one second, an arming LED 26 is illuminated. The arming LED 26 indicates to the competitor that the timer is ready and the competition can be begin. The timer 20 is triggered by releasing the touch pad triggers 30. The timer 20 is stopped by applying pressure again to the touch pad triggers 30. The timer is reset by utilizing the reset switch 23 that is a push button, a flip switch or any other similar device.

A competitor will use the mat by first placing both hands on the touch pad triggers 30. Indicator lamps or light emitting diodes 25 and 27 (shown in FIGS. 1 and 5) will light up to show that each touch pad has been activated. Alternatively, a single LED may also be used to indicate the presence of both hands. Once both hands are in place for a full second, an arming lamp or light emitting diode 26 is illuminated to show that the timer is armed and ready for the competitor to begin. Although this embodiment utilizes light emitting diodes to show the competitor that the timer is armed and ready to begin, one of skill in the art can envision other means of notifying the competitor that the timer is armed, including but not limited to an audible indicator or a flashing light.

The competitor's hands will then leave the touch pad triggers, starting the timer. A readout display 21 indicates the amount of time that has passed. Once the sequence has been completed, both of the competitor's hands must again rest on the touch pad triggers. This will stop the timer. The final time remains on the readout display to allow the time to be recorded. To begin another timed sequence, the competitor or a judge pushes a reset button 23.

It should be appreciated that the timer could easily be connected, in any suitable manner, to a remote time display devices that would compute time or store time, such as a computer, or other electronic device that stores information (a palm pilot, etc.). In such an arrangement, a data cable would connect the timer which would be connected to the computer or other device (not shown). A computer program can direct the computer to begin accruing time when the trigger is activated, to stop accruing time when the trigger is reactivated, or the computer could simply display the time as calculated by the timer. Once time is stopped, the computer program could direct the judge or competitor to store the time or to delete the time.

Figure 6:
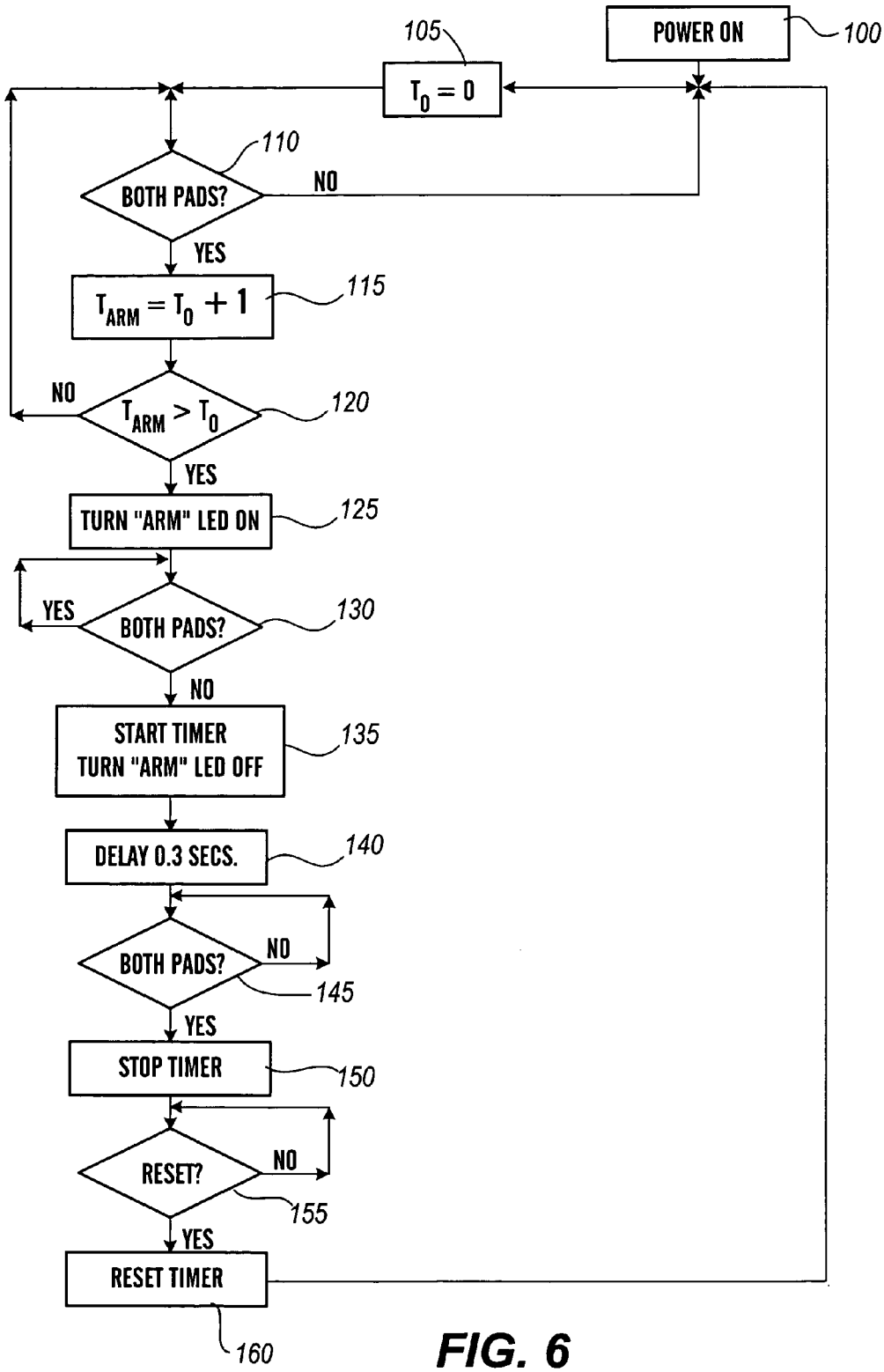
FIG. 6 depicts a flowchart of the operation of the timer of one embodiment of the present invention.

The flowchart for the timing mechanism of one embodiment of the present invention is shown in FIG. 6. The power is turned on in step 100. The timer then sets a variable $T_0$ to be zero in step 105. When the variable, $T_0$ is zero, the light emitting diodes are off. The touch pad triggers are activated by placing the hands of the competitor on or over the triggers and the microprocessor of the timer analyzes whether both touch pad triggers are activated, step 110. When both triggers are activated, the microprocessor adds 1 to the value of $T_0$ in step 115, then compares the value of $T_0$ to another preset variable, $T_{arm}$, in step 120. The microprocessor then determines whether $T_0$ is greater than $T_{arm}$, step 120. If not, the microprocessor reverts to step 110. If $T_0$ is greater than $T_{arm}$, the microprocessor directs current to the "ARM" light emitting diode, illuminating the diode, as shown in step 125. If not, the process begins again at step 110 until both pads have been activated for the required time $T_{arm}$.

The hands must be removed from both pads in order to move from the "ARM" state to accruing time. The "ARM" LED is the signal for the competitor to begin the competition. Once the competitor notices the illumination of the "ARM" LED, the competitor is then free to remove both hands from the touch pad triggers. Then, the microprocessor checks whether both touch pad triggers are activated, in step 130. If the pads are not activated, the "ARM" LED is turned off and the timer is started, step 135. A delay is built into this embodiment of the present invention, step 140. This delay prevents errant starting of the timer by the competitor if the competitor's hands were to leave the pads for less than 0.3 seconds. The delay of 0.3 seconds shown in step 140 is a debounce timer that does not affect the accumulating time of the competitor. The purpose of the delay is to eliminate errant STOP signals that could occur as the competitor's hands are leaving the triggers. Since actual competitive times of less than 0.3 seconds are not likely, the delay does not interfere with the function of the device and does not affect the measured time.

When the touch pad triggers are reactivated, the microprocessor checks to ensure that reactivation occurs on both touch pad triggers, step 145. If not, the timer keeps accruing time. If so, the timer is stopped, step 150. The final time is displayed on the display readout until the reset button is pressed, steps 155 and 160. Once the timer is reset, the variable $T_0$ is set back to zero and the timer is ready to time another competition.

Referring now to FIGS. 7–11, an alternative embodiment of a two-piece timing mechanism is shown. This embodiment of the present invention includes an upper timing portion 20A and a lower timing portion 20B that selectively interconnects to sandwich the mat 10 therebetween, to thus secure the mat 10 firmly to the timing mechanism. This embodiment may be used with any sized or shaped mat depending on the needs of the competitor or competition. In addition, a plurality of timers 20 may be used with a single large mat, or the timer 20 may be used remotely from the mat 10.

Figure 7:
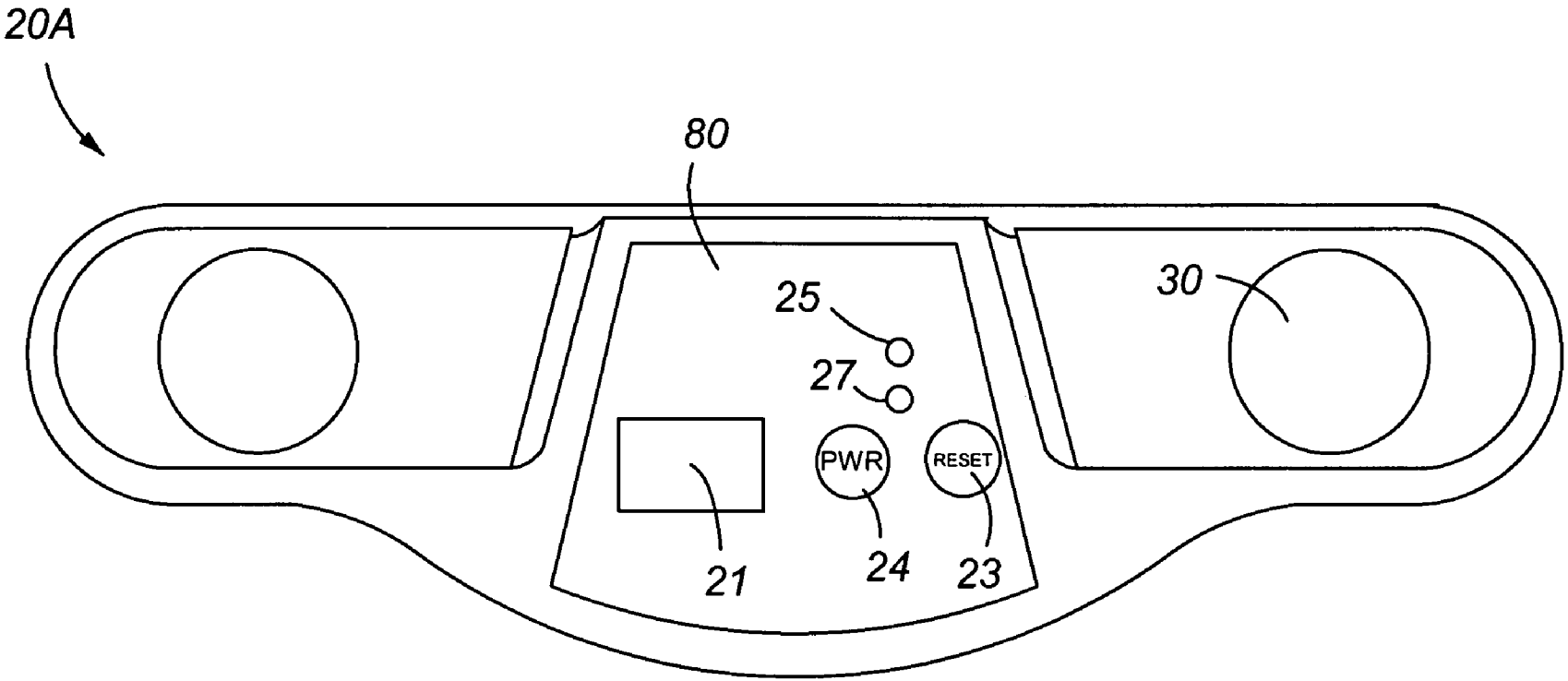
FIG. 7 depicts a top view of an upper portion of a two-piece timer of an alternate embodiment of the invention.

Referring now to FIG. 7, an upper portion 20A of a two-piece timer is shown. This portion of the timer is similar to that of those described above, wherein a plurality of triggers 30, a read out display 21, a power button 24, a reset button 23, and indicator lights 25 & 27 are provided. This portion of the two-piece timing mechanism functions similar to those already described. The competitor engages, then releases, both triggers 30 to initiate timing. Time elapsed from the triggering event would be then displayed on the read out display 21. This portion of the two piece timing mechanism also may include a console 80 that is tilted from the plane of the triggers 30, wherein the read out display 21 and indicator lights 25 & 27 may be more easily viewed. However, one skilled in the art will appreciate that the timing mechanism or the read out display 21 and associated lights and switches may be in line with the triggers 30, as described in some of the other embodiments of the present invention.

Figure 8:
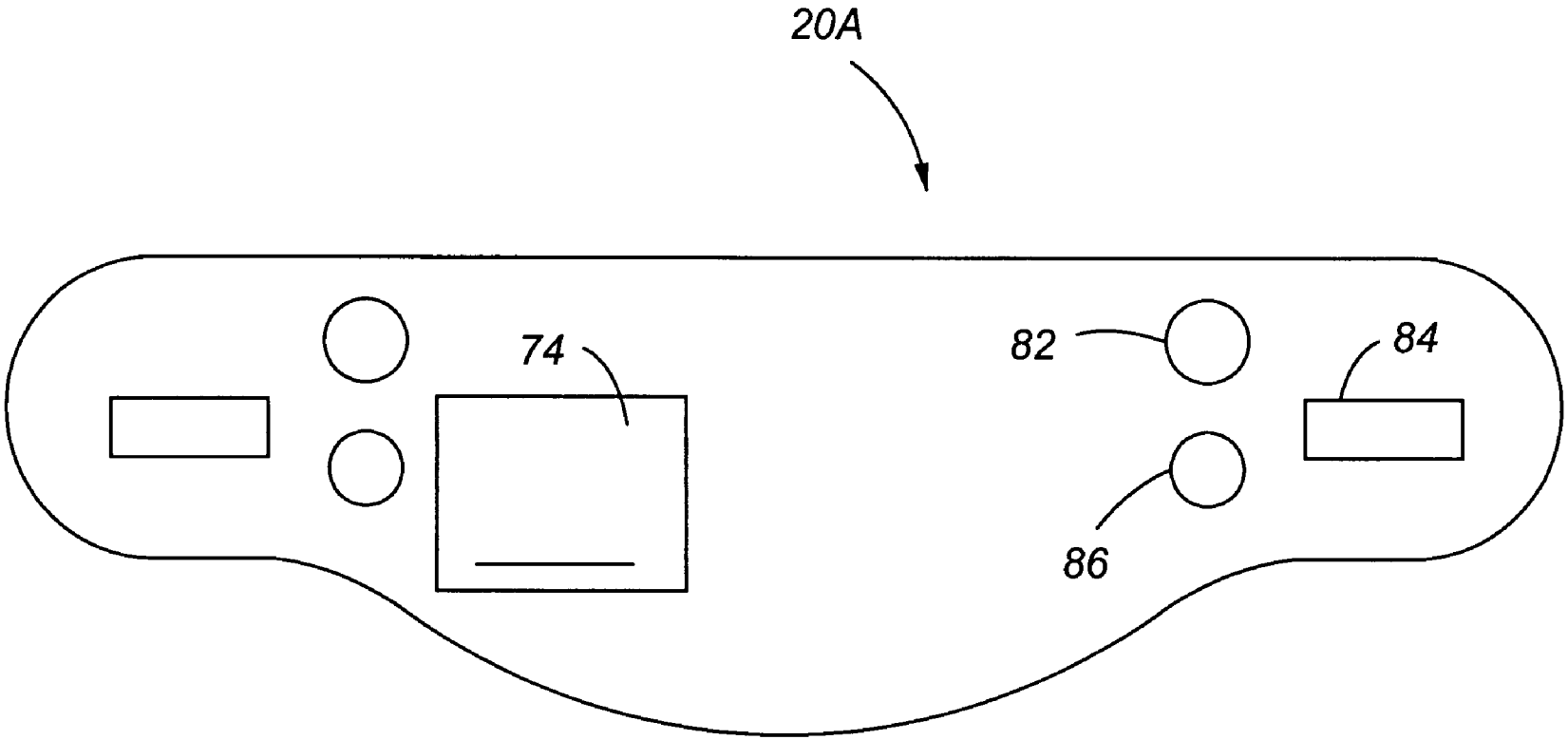
FIG. 8 depicts a bottom view of the upper portion of the two-piece timer shown in FIG. 7.

Referring now to FIG. 8, a bottom view of the upper portion 20A of the two piece timing mechanism is shown. A power supply 74, which may be battery or a hardline to a power source, is provided for supplying electricity to the timer. In addition, a plurality of apertures are provided for interconnection with a lower portion of the two-piece timing mechanism. More specifically, a plurality of boss cavities 82 are provided that receive bosses of the lower portion of the timer, which will be explained in more detail below. In addition, a plurality of alignment tab cavities 84 are provided to ensure proper engagement of both portions of the two-piece timing mechanism. Finally, a magnet 86 or a ferromagnetic material may be provided in the body of the upper portion 20A of the two piece timing mechanism for magnetic connection to another magnet or ferromagnetic material of the lower portion. The upper portion 20A may be constructed of metal, plastic, rubber, wood, or any other rigid material. Preferably, in one embodiment of the present invention, a plastic material that is easily molded to any shape is provided that includes cavities for the interconnection of the magnets 84 or ferromagnetic metallic materials, as should be appreciated by one skilled in the art. One skilled in the art will also appreciate that other attachment devices may be used, such as hook and loop fasteners, etc.

Figure 9:
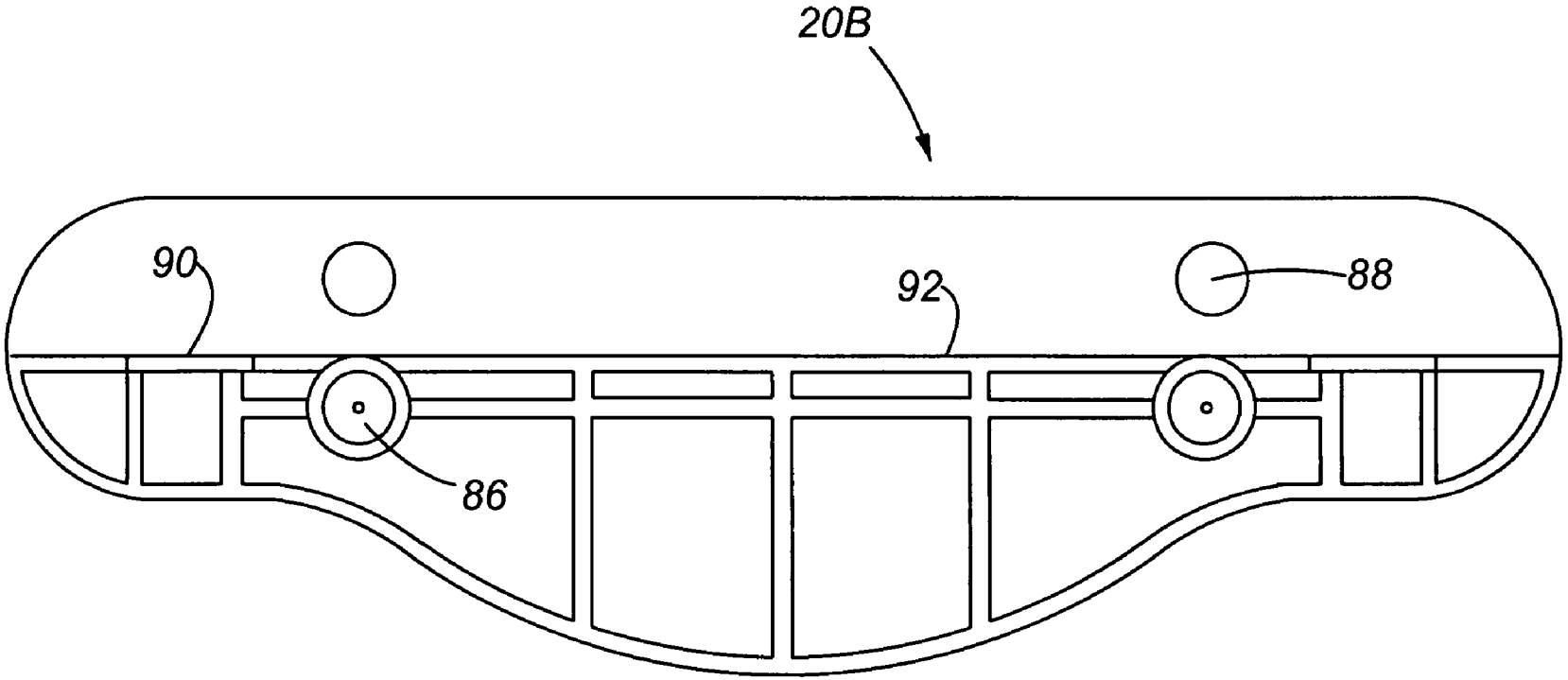
FIG. 9 depicts a top view of a lower portion of the two-piece timer of an alternate embodiment of the invention.

Referring now to FIG. 9, the lower portion 20B of the two piece timing mechanism is shown. One embodiment of the present invention is simply a base portion for the interconnection to the timing mat and the upper portion of the two-piece timing mechanism. As shown, a plurality of alignment bosses 88 are provided that interconnect with associated apertures in a mat, which effectively align the lower portion 20B of the two-piece timing mechanism with the mat. In addition, the alignment bosses 88 may be made to protrude out of the mat such that they may be selectively locked into the boss apertures of the upper portion of the two-piece timing mechanism. Further, a plurality of magnets 86 or ferromagnetic materials are provided that are associated with the magnets or ferrometallic materials of the upper portion of the two piece timing mechanism, such that the magnets, when engaged, provide a connection force between the two portions. The lower portion 20B of the two-piece timing mechanism also may include a plurality of alignment tabs 90 that protrude upwardly. The alignment tabs 90 may be used to perform gross alignments with the alignment tab cavities of the upper portion of the two-piece timing mechanism such that engagement between the alignment boss 88, alignment cavity and associated magnets 86, is ensured. Further, as described herein, the bosses 88 of the lower portion of the two-piece timing mechanisms are shown emanating from the lower portion. One skilled in the art will appreciate that the present invention will function equally well to that already described if the bosses 88 emanate from the upper portion. The main function of the bosses 88 is to restrain the two-piece timer relative to the mat in at least 3 degrees of freedom. The addition, the magnets 86 also help to secure portions of the two-piece timing mechanism together and to provide further restriction of movement between the timer and the mat. Finally, a wall 92 may be provided such that the outside edge of the mat may be firmly abutted thereto.

Figure 10:
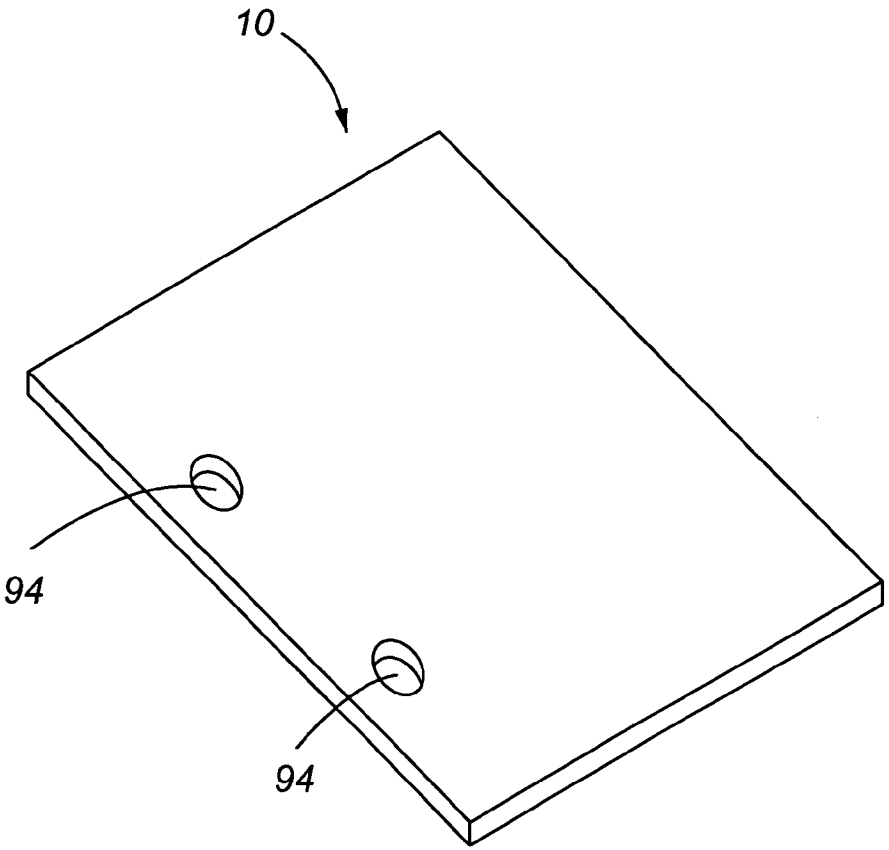
FIG. 10 depicts a perspective view of the mat for use with a two-piece timer embodiment of the present invention.

Referring now to FIG. 10, a mat 10 of one embodiment of the present invention that is adapted for interconnection with the two-piece timing mechanism is shown. The mat 10 of this embodiment of the present invention is substantially similar to the ones already described. However, the mat 10 of this embodiment of the present invention also includes a plurality of apertures 94 for engagement with the bosses of the lower portion of the two-piece timing mechanism. In addition, one skilled in the art should appreciate that the mat 10 may include a plurality of apertures 94 such that a plurality of timing mechanisms may be employed therewith.

Figure 11:
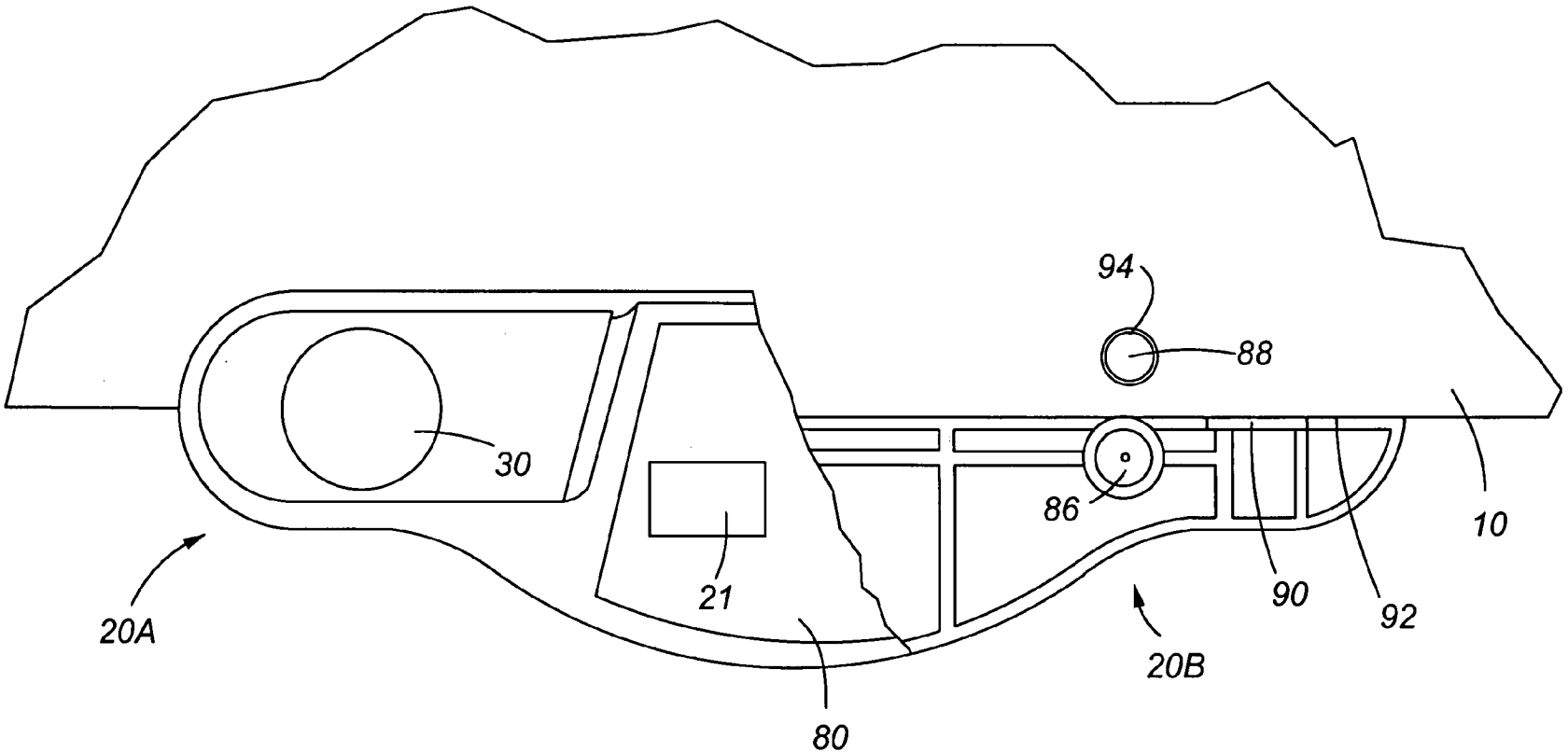
FIG. 11 is a partial top view of the two-piece timer of one embodiment of the present invention shown connected to the mat.

Referring now to FIG. 11, the two-piece timing mechanism interconnected to the mat 10 is shown. More specifically, the lower portion 20B is shown connected to a cut-away view of the upper portion 20A of the two piece timing mechanism thus revealing the engagement of the boss 88 through the aperture 94 of the mat 10. In operation, one may simply lie the lower portion 20B of the two-piece timing mechanism on to a flat surface. Next the mat 10 would be placed above the lower portion 20 of the two-piece timing mechanism wherein the bosses 88 would be then threaded through the apertures 94 of the mat 10. Next, the upper portion 20A of the two-piece timing mechanism would be aligned with the lower portion 20B using the alignment tab 90 or simply by aligning the outer surfaces of the two portions of the timing mechanism. However, as should be appreciated by one skilled in the art, the portions of the timing mechanism may have any shape such that the outer contours of the upper and lower portions of the timing mechanism do not have to be similar. Once the lower and upper portions are grossly aligned using the aligning tabs 90, the two pieces are simply locked together, thus sandwiching the mat 10 therebetween. In order to ensure a flat mat after interconnection, a portion of the underside of the mat 10 may be removed to accommodate the material of the lower portion 20B of the two piece timing mechanism.

While various embodiment of the present invention have been described in detail, it is apparent that modifications and alterations of those embodiments will occur to those skilled in the art. However, it is to be expressly understood that such modifications and alterations are within the scope and spirit of the present invention, as set forth in the following claims.

What is claimed is:

1. An apparatus for timing cup stacking competitions comprising:

a mat;

at least one timer for connection to the mat, the timer comprising an upper portion and a lower portion, the upper portion and the lower portion fashioned to engage the mat therebetween;

a trigger integrated into the timer, the trigger having two distinct pads, wherein the trigger is unaffected by cup stacking; and wherein a first activation of the trigger starts the timer and a second activation of the trigger stops the timer, wherein the first activation and the second activation require substantially simultaneous contact with the two distinct pads of the trigger.

2. The apparatus of claim 1, wherein the upper timing potion includes a readout display, at least one indicator light, and at least one button.

3. The apparatus of claim 1, wherein the trigger is situated on the upper portion.

4. The apparatus of claim 1, wherein the upper portion includes at least one cavity and at least one attachment mechanism that are integrated into a lower surface of the upper portion, and wherein the lower portion includes at least one boss for engagement into the at least one cavity of the upper portion and at least one attachment mechanism for selective connection with the attachment mechanism of the upper timing mechanism that are integrated into an upper surface of the lower portion.

5. The apparatus of claim 4, wherein the at least one attachment mechanism of the upper portion and the at least one attachment mechanism of the lower portion is at least one of a magnet, a ferromagnetic material, and a hook and loop fastener.

6. The apparatus of claim 4, wherein the at least one cavity of the upper portion and the at least one boss of the lower portion are of a generally cylindrical shape and wherein the mat includes an aperture through which the boss may travel.

7. The apparatus of claim 1, wherein the trigger is at least one of a pressure sensitive switch, a capacitive switch, a photo optic switch, a photo electric switch, a dry contact switch, and an inductive switch.

8. The apparatus of claim 1, wherein the trigger is comprised of a plurality of switches operated in parallel or in series.

9. The apparatus of claim 1, wherein the mat has a non-slip surface on one side and a smooth, even surface on the reverse side.

10. The apparatus of claim 1, wherein the mat is made from fabric, fabric with a substrate, a foam substrate with a fabric surface, fabric with a backing, short nap carpet, closed cell foam, and vinyl with a substrate.

11. The apparatus of claim 1, wherein the mat is imprinted with a design.

12. The apparatus of claim 1, wherein the trigger is covered with a film covering.

13. The apparatus of claim 1, wherein the upper timing portion comprises at least a microprocessor, a light emitting diode display, a plurality of light emitting diodes, a reset switch, a power switch, and a power source.

14. The apparatus of claim 1, wherein the timer includes a delay to prevent errant starting signals.

15. The apparatus of claim 14, wherein the delay ranges from about 0.01 seconds to about 0.5 seconds.

16. An apparatus for timing cup stacking competitions comprising:

a mat with at least one aperture;

at least one timer for connection to the mat, the timer comprising an upper portion and a lower portion that are fashioned to retain the mat therebetween; and a plurality of triggers connected to the upper portion of the at least one timer wherein a first substantially simultaneous activation of at least two of the plurality triggers starts the timer and a second substantially simultaneous activation of at least two of the plurality triggers stops the timer.

17. The apparatus of claim 16, wherein said upper portion includes a console with a readout display, at least one indicator light, and at least one button.

18. The apparatus of claim 16, wherein the upper portion includes at least one cavity and at least one attachment mechanism that are integrated into a lower surface thereof, and wherein the lower portion includes at least one boss for engagement into the at least one cavity of the upper portion and at least one attachment mechanism for selective connection with the attachment mechanism.

19. The apparatus of claim 16, wherein the plurality of triggers can be activated in parallel or in series.

20. The apparatus of claim 16, wherein the upper timing portion includes a power supply.

21. A method of timing competitions having tasks to be completed, comprising:

providing a timer with a lower portion, the lower portion having an upper surface with at least one boss extending therefrom;

connecting the lower portion to a mat having at least one aperture by placing the at least one boss through said at least one aperture wherein a portion of the at least one boss protrudes from the mat;

connecting an upper portion to the lower portion, wherein the mat is positioned between the upper portion and the lower portion and wherein the upper portion includes at least one cavity integrated into a lower surface thereof to receive the at least one boss;

arming a trigger that comprises a plurality of pads;

starting the timer by interaction with at least two of the plurality of pads by a single individual;

completing the desired tasks; and stopping the timer.

22. The method according to claim 21, wherein the task to be completed is a cycle stack of a plurality of cups.

23. The method according to claim 21, wherein the task to be completed is at least one of a 3-6-3, a 1-10-1, a 3-3-3, a 10-15, a 6-6, and a 15-21 stack of a plurality of cups.

24. A system for cup stacking competitions utilizing an apparatus for timing the competitions, comprising:

a mat;

a timer for connection to the mat, further comprising an upper portion and a lower portion, the upper portion and the lower portion fashioned to sandwich at least a portion of the mat therebetween;

a trigger connected to the upper portion wherein a first activation of the trigger starts the timer and a second activation of the trigger stops the timer; and a plurality of cups to be stacked.

25. The system of claim 24, further comprising an enclosure for housing the system when the system is not in use.

26. The system of claim 24, wherein the trigger is at least one of a capacitive switch, an inductive switch, a dry contact switch, a photo optic switch, a photo electric switch, and a pressure sensitive switch.

27. The apparatus of claim 24, wherein the mat is made from fabric, fabric with a substrate, a foam substrate with a fabric surface, fabric with a backing, short nap carpet, closed cell foam, and vinyl with a substrate.

28. The apparatus of claim 24, wherein the upper timing portion comprises a microprocessor, a light emitting diode display, a plurality of light emitting diodes, a reset switch, a power switch, and a power source.

29. The apparatus of claim 24, wherein the timer includes a delay to prevent errant starting signals.

30. The apparatus of claim 24, wherein the delay ranges from about 0.01 seconds to about 0.5 seconds.

31. An apparatus for timing cup stacking competitions comprising: a competition surface;

a timing means for connection to the competition surface further comprising an upper timing means and a lower timing means, the upper timing means and the lower timing means fashioned to connect with the competition surface;

a first trigger means connected to the upper timing means, wherein the first trigger means is unaffected by the cup stacking;

a second trigger means connected to the upper timing means, wherein the second trigger means is unaffected by the cup stacking;

wherein a first activation of the first trigger means and the second trigger means starts the timer and a second activation of the first trigger means and the second trigger means stops the timer, and, wherein the first activation and the second activation require substantially simultaneous contact with the first trigger means and the second trigger means.

32. The apparatus according to claim 31, wherein the first trigger means and the second trigger means is at least one of a capacitive switch, an inductive switch, a dry contact switch, a photo optic switch, a photo electric switch, and a pressure sensitive switch.

33. The apparatus according to claim 31, wherein the competition surface is at least one of a mat, a cushion, and a rug.

34. The apparatus of claim 31, wherein the first trigger means and the second trigger means is comprised of a plurality of switches operated in parallel or in series.

35. The apparatus of claim 31, wherein the competition surface has a non-slip surface on one side and a smooth, even surface on the reverse side.

36. The apparatus of claim 31, wherein the competition surface is made from at least one of a fabric, a fabric with a substrate, a fabric with a backing, a short nap carpet, a foam substrate with a fabric surface, a closed cell foam, and a vinyl with a substrate.

37. The apparatus of claim 31, wherein first trigger means and the second trigger means is covered with a film covering.

38. The apparatus of claim 31, wherein the timing means comprises a microprocessor, a light emitting diode display, a plurality of light emitting diodes, a reset switch, a power switch, and a power source.

39. The apparatus of claim 31, wherein the timer includes a delay to prevent errant starting signals.

* * * * *